US005434481A

United States Patent [19]

Nilssen

[11] Patent Number: 5,434,481

[45] Date of Patent: Jul. 18, 1995

[54] ELECTRONIC BALLAST FOR FLUORESCENT LAMPS

[76] Inventor: Ole K. Nilssen, 408 Caesar Dr., Barrington, Ill. 60010

[21] Appl. No.: 912,587

[22] Filed: Jul. 13, 1992

Related U.S. Application Data

[63] Continuation of Ser. No. 646,221, Jan. 28, 1991, abandoned, which is a continuation-in-part of Ser. No. 546,267, Jun. 29, 1990.

[51] Int. Cl.[6] ..... H05B 41/16

[52] U.S. Cl. ..... 315/247; 315/244; 315/209 R; 315/224

[58] Field of Search ..... 315/119, 247, 224, 225, 315/244, DIG. 5, 209 R; 307/326; 328/7

[56] References Cited

U.S. PATENT DOCUMENTS 4,463,287 7/1984 Pitel ..... 315/247
4,700,111 10/1987 Folwell et al. ..... 315/224
5,057,748 10/1991 Doss ..... 315/225

*Primary Examiner*—Robert J. Pascal
*Assistant Examiner*—Reginald A. Ratliff

[57] ABSTRACT

An electronic ballast draws current from the power line with power factor over 90% and total harmonic distortion under 20%, and powers two series-connected 48"/T-12 fluorescent lamps with a 30 kHz current having crest-factor better than 1.7. The ballast includes a power-factor-correcting up-converter and a half-bridge inverter providing a 30 kHz squarewave voltage across a series-resonant high-Q L-C circuit. When the L-C circuit is not loaded, the magnitude of the 30 kHz voltage developing across its tank capacitor is clamped by non-dissipative means to a peak-to-peak magnitude equal to the magnitude of the inverter's DC supply voltage. The ballast output voltage consists of the sum of two components: (i) the 30 kHz voltage across the tank capacitor, and (ii) a 30 kHz voltage obtained from an auxiliary winding on the tank inductor. The ballast output voltage is non-pulsing and is provided at a pair of ballast output terminals across which are series-connected the two 48"/T-12 fluorescent lamps. When the fluorescent lamps are non-connected, the amount of power drawn by the ballast from the power line is less than 10 Watt. Shock hazard mitigation is attained by making the ballast output voltage balanced about ground and by making the magnitude of this 30 kHz ballast output voltage as measured between ground and either one of the ballast output terminals lower than what is required to ignite one of the fluorescent lamps. Control of the magnitude of the inverter's DC supply voltage is attained in a "bang-bang" manner in that the up-converter is disabled whenever the magnitude of the DC supply voltage increases above a certain level and it is re-enabled whenever this magnitude decreases below a certain lower level.

16 Claims, 2 Drawing Sheets

ELECTRONIC BALLAST FOR FLUORESCENT LAMPS

RELATED APPLICATIONS

This application is a continuation of Ser. No. 07/646,221 filed Jan. 28, 1991, now abandoned; which is a continuation-in-part of Ser. No. 07/546,267 filed June 29, 1990.

BACKGROUND OF THE INVENTION

1. Field of the Invention

The present invention relates to electronic or inverter-type ballasts for fluorescent and other gas discharge lamps.

2. Description of Prior Art

In power-line-operated electronic ballasts for gas discharge lamps, it is often important that the current drawn from the power line be drawn with higher power factor and lower harmonic distortion than what usually results with such power supplies.

For instance, without any added power factor correction means, the power factor associated with ordinary power-line-operated electronic fluorescent lamp ballasts will be on the order of 60% or less and the total harmonic distortion of the current drawn from the power line will be over 40%. On the other hand, in the most common of all applications of such ballasts, it is important that the power factor be at least 90% and the total harmonic distortion be no higher than about 20%.

The conventional way of improving or correcting the power factor of an inverter-type power supply involves the use of an energy-storing inductor means placed on the power-input-side of the inverter-type power supply, either just in front of or just behind the line voltage rectifier means.

One particular power factor correction circuit based on this principle is described in U.S. Pat. No. 4,075,476 entitled Sinusoidal Wave Oscillator Ballast Circuit; another one is described in U.S. Pat. No. 4,277,726 entitled Solid-State Ballast for Rapid-Start Type Fluorescent Lamps.

However, there are significant penalties in cost, weight, size and/or efficiency associated with the use of this method of power factor correction.

The present invention involves the use of electronic means for effecting the desired power factor correction and harmonic distortion reduction, thereby obviating the need for said energy-storing inductor means and thereby greatly minimizing said penalties of cost, weight, size and efficiency.

SUMMARY OF THE INVENTION

Objects of the Invention

An object of the present invention is that of providing for a cost-effective electronic ballast means for fluorescent and other gas discharge lamps.

This as well as other objects, features and advantages of the present invention will become apparent from the following description and claims.

Brief Description

An electronic ballast draws current from the power line with power factor over 90% and total harmonic distortion under 20%, and powers two series-connected 48"/T-12 fluorescent lamps with a 30 kHz current having crest-factor better than 1.7.

The ballast includes a power-factor-correcting up-converter and a half-bridge inverter providing a 30 kHz squarewave voltage across a series-resonant high-Q L-C circuit. When the L-C circuit is not loaded, the magnitude of the 30 kHz voltage developing across its tank capacitor is clamped by non-dissipative means to a peak-to-peak magnitude equal to the magnitude of the inverter's DC supply voltage.

The ballast output voltage consists of the sum of two components: (i) the 30 kHz voltage across the tank capacitor, and (ii) a 30 kHz voltage obtained from an auxiliary winding on the tank inductor. The ballast output voltage is non-pulsing and is provided at a pair of ballast output terminals across which are series-connected the two 48"/T-12 fluorescent lamps.

In situations where the fluorescent lamps are non-connected (i.e., where the series-resonant high-Q L-C circuit is not loaded except by the voltage clamping means), the amount of power drawn by the ballast from the power line is less than about 10 Watt.

Shock hazard mitigation is attained by making the 30 kHz ballast output voltage substantially balanced about ground and by making the magnitude of this 30 kHz ballast output voltage as measured between ground and either one of the ballast output terminals lower than what is required to ignite one of the 48"/T-12 fluorescent lamps.

Control of the magnitude of the inverter's DC supply voltage is attained in a "bang-bang" manner. The up-converter is disabled whenever the magnitude of the DC supply voltage increases above a first pre-determined level, and it is re-enabled whenever this magnitude decreases below a second (lower) pre-determined level.

DESCRIPTION OF THE PREFERRED EMBODIMENT

Details of Construction

Figure 1:
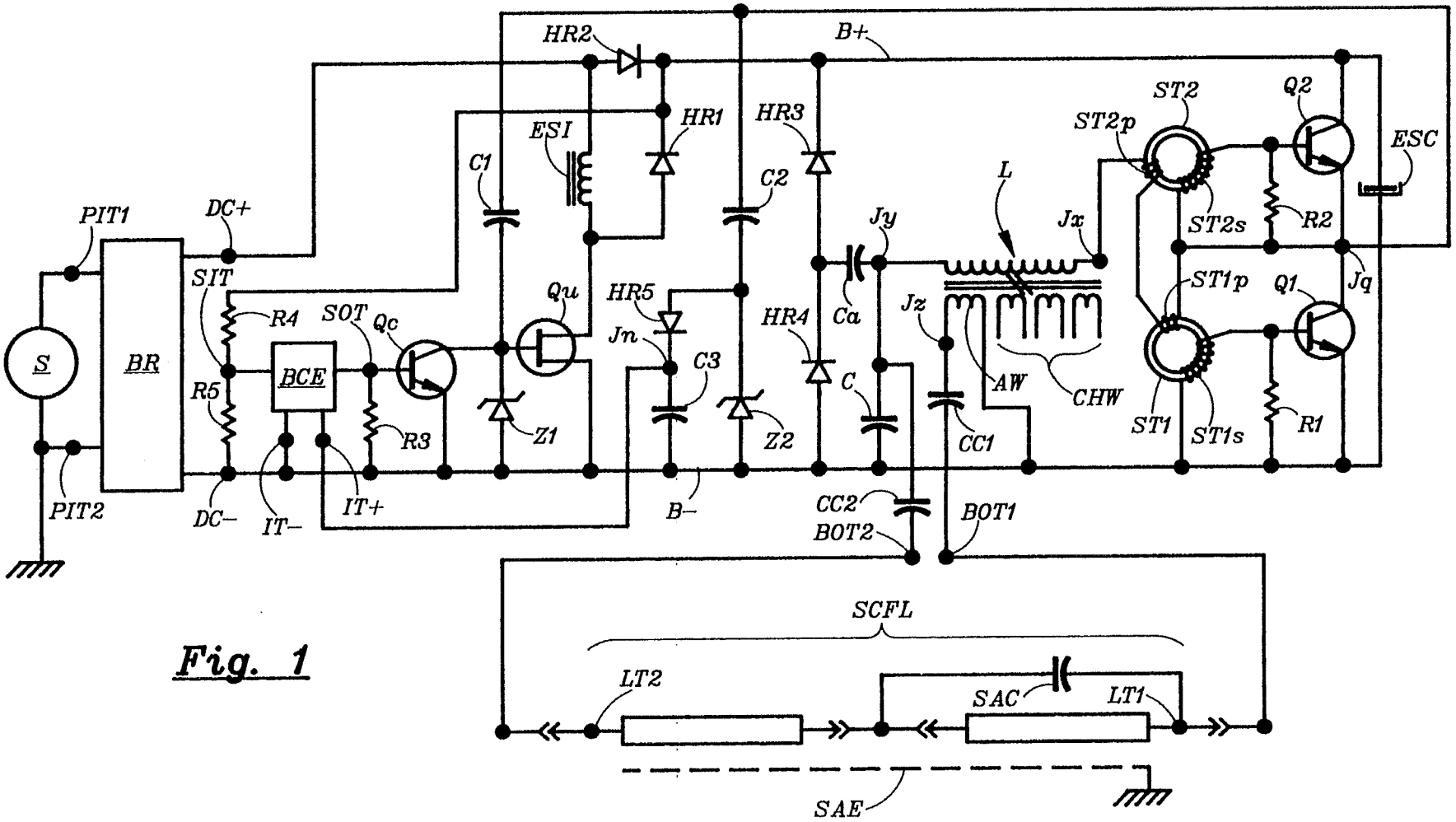
FIG. 1 schematically illustrates the preferred embodiment of the invention.

In FIG. 1, a source S of 120 Volt/60 Hz voltage is applied to power input terminals PIT1 and PIT2 of a full-wave bridge rectifier BR, the unidirectional voltage output of which is provided between DC output terminals DC− and DC+. The DC− terminal is connected with a B− bus.

A field-effect transistor Qu is connected with its source terminal to the B− bus and with its drain terminal to the anode of a high-speed rectifier HR1, whose cathode is connected with a B+ bus. Another high-speed rectifier HR2 is connected with its anode to the DC+ terminal and with its cathode to the B+ bus. An energy-storing inductor ESI is connected between the DC+ terminal and the drain terminal of transistor Qu; and an energy-storing capacitor ESC is connected between the B− bus and the B+ bus.

Between the B+ bus and the B− bus are also connected a series-combination of two transistors Q1 and Q2; the emitter of transistor Q1 being connected with the B− bus; the collector of transistor Q2 being connected with the B+ bus; and the collector of transistor Q1 and the emitter of transistor Q2 are both connected with a junction Jq.

A saturable current transformer ST1 has a secondary winding ST1s connected between the base and the emitter of transistor Q1; and a saturable current transformer ST2 has a secondary winding ST2s connected between the base and the emitter of transistor Q2. A resistor R1 is also connected between the base and the emitter of transistor Q1; and a resistor R2 is connected between the base and the emitter of transistor Q2.

Saturable transformer ST1 has a primary winding ST1p, and saturable transformer ST2 has a primary winding ST2p; which two primary windings are series-connected between junction Jq and a junction Jx.

A tank inductor L is connected between junction Jx and a junction Jy; and a tank capacitor C is connected between junction Jy and the B− bus. An auxiliary capacitor Ca is connected between junction Jy and the anode of a high-speed rectifier HR3, whose cathode is connected with the B+ bus. A high-speed rectifier HR4 is connected with its cathode to the anode of rectifier HR3 and with its anode to the B− bus.

Tank inductor L has an auxiliary winding AW whose terminals are connected between the B− bus and a junction Jz. A coupling capacitor CC1 is connected between junction Jz and a first ballast output terminal BOT1. A coupling capacitor CC2 is connected between junction Jy and a second ballast output terminal BOT2.

Two series-connected fluorescent lamps SCFL have lamp terminals LT1 and LT2; which are disconnectably connected with ballast output terminals BOT1 and BOT2. The fluorescent lamps have thermionic cathodes; which cathodes are heated by power provided via cathode heater windings CHW wound as loosely-coupled secondary windings on tank inductor L.

A starting aid capacitor SAC is connected in parallel with one of the fluorescent lamps; and a starting aid electrode SAE is disposed adjacent both fluorescent lamps.

A capacitor C1 is connected between junction Jq and the gate terminal of transistor Qu; and a Zener diode Z1 is connected with its cathode to the gate terminal of transistor Qu and with its anode to the B− bus.

A capacitor C2 is connected between junction Jq and the cathode of a Zener diode Z2, whose anode is connected with the B− bus. A high-speed rectifier HR5 is connected with its anode to the cathode of Xener diode Z2 and with its cathode to a junction Jn. A capacitor C3 is connected between junction Jn and the B− bus.

A control transistor Qc is connected with its collector to the gate terminal of transistor Qu and with its emitter to the B− bus. A resistor R3 is connected between the base of transistor Qc and the B− bus. A bistable circuit element BCE (such as a Schmitt trigger) has: (i) a positive DC input terminal IT+ connected with junction Jn; (ii) a negative DC input terminal IT− connected with the B− bus; (iii) a signal input terminal SIT; and (iv) a signal output terminal SOT connected with the base of transistor Qc.

A resistor R4 is connected between signal input terminal SIT and the B+ bus; and a resistor R5 is connected between signal input terminal SIT and the B− bus.

Explanation of Waveforms

With reference to the circuit diagram of FIG. 1, the various waveforms of FIG. 2 may be explained as follows.

Waveform (a) represents the 120 Volt/60 Hz power line voltage present across power input terminals PIT1-/PIT2.

Waveform (b) represents the waveform of the current flowing from the power line source S into power input terminals PIT1/PIT2 under a condition of normal operation at full load.

Waveform (c) represents the waveform of the current flowing from the power line source S into power input terminals PIT1/PIT2 under a condition of normal operation at no load, such as with the fluorescent lamps SCFL disconnected.

Waveform (d) represents the 30 kHz substantially squarewave voltage provided at the inverter's output terminal (as referenced to the B− bus), which output terminal is junction Jx.

Waveform (e) represent the 30 kHz voltage present at junction Jy (i.e., across tank capacitor C) under a condition of normal operation at full load.

Waveform (f) represents the 30 kHz voltage present between junctions Jx and Jy (i.e., across tank inductor L) under a condition of normal operation at full load.

Waveform (g) represents the net total 30 kHz ballast output voltage (as present between ballast output terminals BOT1/BOT2) under a condition of normal operation at full load.

Waveform (h) represents the 30 kHz current flowing through fluorescent lamps FL under a condition of normal operation at full load.

Waveform (i) represents the 30 kHz voltage present at junction Jy under a condition of normal operation at no load.

Waveform (j) represents the 30 kHz voltage present between ballast output terminals BOT1/BOT2 under a condition of normal operation at no load. Thus, this voltage represents the voltage available at the ballast output terminals prior to lamp ignition.

Details of Operation

The unfiltered full-wave-rectified power line voltage present between the DC− terminal and the DC+ terminal has an instantaneous absolute magnitude that is substantially equal to that of the 120 Volt/60 Hz power line voltage impressed between power input terminals PIT1 and PIT2. Thus, within a few milliseconds of application of this power line voltage, energy-storing capacitor ESC will be charged-up to the peak magnitude (i.e., about 160 Volt) of the power line voltage.

Self-sustaining inverter operation is then initiated by providing a brief current pulse to the base of transistor Q1. (While this can be done manually, in an actual ballast the triggering will be done automatically by way of a simple trigger means consisting of a resistor, a capacitor and a Diac.)

Figure 2:
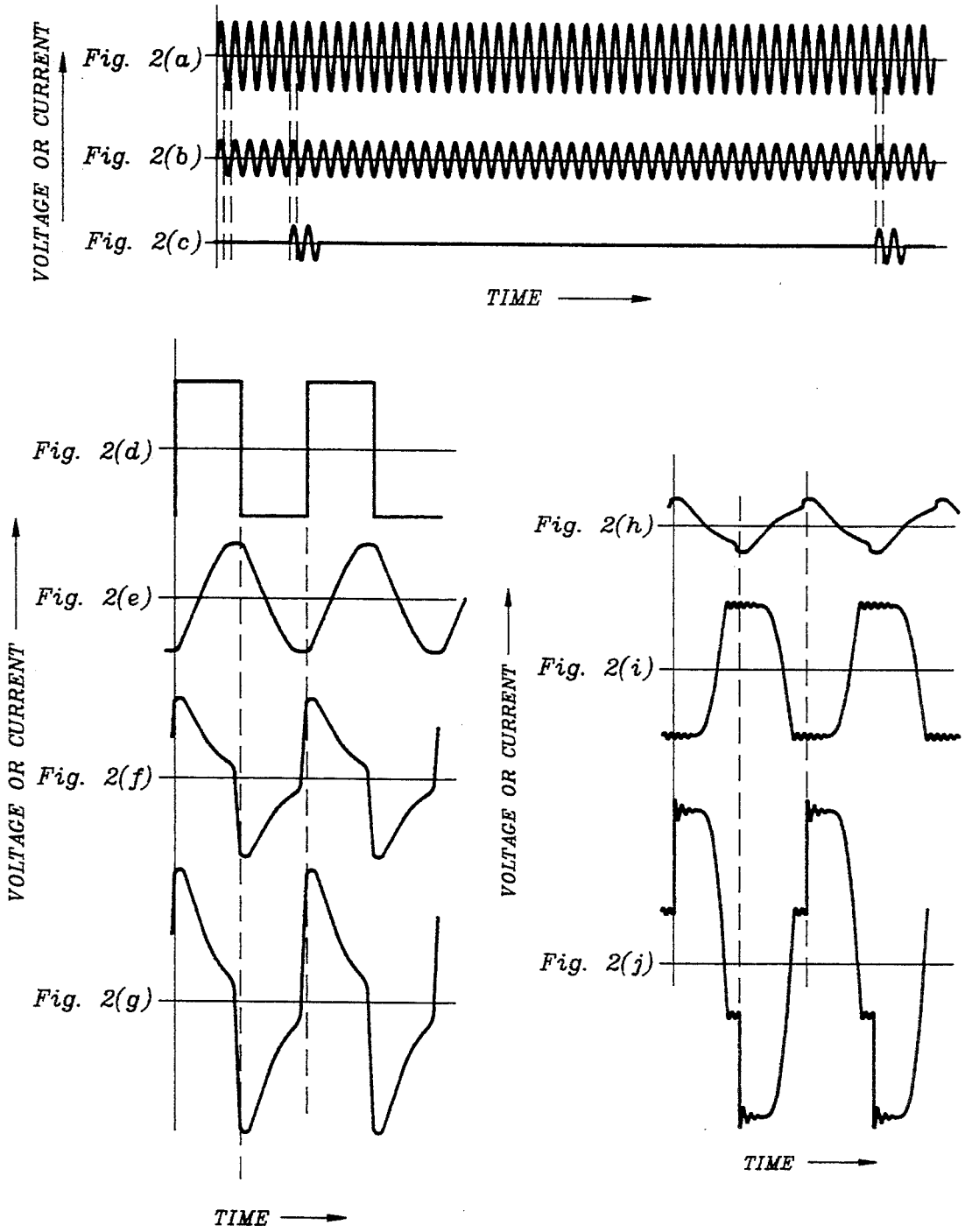
FIG. 2 illustrates typical voltage and current waveforms associated with the embodiment of FIG. 1.

Once triggered, the inverter (which consists of principal components ESC, Q1, Q2, ST1, ST2, L, C, Ca, HR3 and HR4) will enter into a mode of stable self-oscillation as a result of the positive feedback provided via transformer ST1 and ST2; and will provide a 30 kHz substantially squarewave voltage at junction Jq; which squarewave voltage (due to the negligible voltage drop across the primary windings of transformers ST1/ST2) will be essentially the same as the squarewave voltage provided at junction Jx—the latter squarewave voltage being illustrated by waveform (d) of FIG. 2.

The inverter's squarewave output voltage is coupled to the gate of field-effect transistor Qu by way of capacitor C1, thereby resulting in a voltage-limited squarewave voltage being provided thereat. More specifically, as the instantaneous magnitude of the voltage at junction Jq starts to rise (i.e., starts going toward a positive potential), a pulse of positive current flows through capacitor C1 and into the gate of Qu, thereby causing the voltage at the gate to increase to the point where Zener diode Z1 starts to conduct in its Zenering mode. That is, by action of Zener diode Z1, the voltage on the gate is prevented from attaining a positive voltage higher than about 15 Volt. Once having increased to 15 Volt positive, however, the gate voltage will remain substantially at that level until a reverse current is provided through capacitor C1; which reverse current will indeed be provided as soon as the instantaneous magnitude of the voltage at junction Jq starts to fall (i.e., starts going toward a negative potential), which will occur about 16 micro-seconds after it started to rise. However, the gate voltage is prevented from going more than about 0.7 Volt negative due to the plain rectifier action of Zener diode Z1.

In other words, a 30 kHz squarewave voltage is provided at the gate of transistor Qu, thereby—at a 30 kHz rate—causing this transistor to switch ON and OFF with about a 50% ON-duty-cycle and a 50% OFF-duty-cycle. Thus, during each positive half-cycle of the gate voltage, energy-storing inductor ESI gets connected across terminals DC− and DC+, thereby to be charged-up from the voltage present therebetween. Then, during each negative half-cycle, the energy having been stored-up in inductor ESI during the previous half-cycle gets deposited on energy-storing capacitor ESC via rectifier HR1.

As long as transistor Qu is switched ON and OFF at a constant frequency (i.e., 30 kHz) and at a constant duty-cycle (i.e., 50%), the amount of energy transferred from the power line to energy-storing capacitor ESC will remain constant as averaged over each half-cycle of the power line voltage. If this constant average flow of power from the power line were to exceed the amount of power drained from energy-storing capacitor ESC, the magnitude of the DC supply voltage present across ESC will increase—eventually to the point of either causing increased power drain or resulting in damage. To prevent the latter situation from occurring, means are provided whereby transistor Qu will be rendered non-conductive if (or whenever) the magnitude of the DC supply voltage across capacitor ESC were to exceed a level of about 500 Volt. If such were indeed to occur, bistable circuit element BCE—which is provided at its signal input terminal SIT with a voltage of magnitude proportional to that of the DC supply voltage—would abruptly change state and start providing base current to transistor Qc from its signal output terminal SOT, thereby causing transistor Qc to become conductive to a degree sufficient to prevent a positive voltage from developing at the gate of transistor Qu, which therefore prevents up-conversion from taking place.

However, once having changed—at a DC supply voltage threshold of about 500 Volt—into the state of providing an output current, bi-stable circuit element BCE will not change back to a state of not providing such an output current until the magnitude of the DC supply voltage has decreased below about 450 Volt, at which point it will abruptly change back to the state of not supplying an output current. In other words, as is common with bi-stable circuit elements (such as a Diac or a Schmitt trigger), a certain amount of hysteresis is provided for; which hysteresis, in this case, is about 10%.

That is, when power drawn from energy-storing capacitor ESC is substantially lower on average than the power provided from the power line, the magnitude of the DC supply voltage will increase, but only until its magnitude reaches 500 Volt; at which point the up-conversion ceases and remains inactive until the magnitude of the DC supply voltage falls back to about 450 Volt, at which point bistable circuit element BCE abruptly ceases to provide base current to transistor Qc, thereby once again to permit positive voltage to develop at the gate of transistor Qu, thereby re-initiating up-conversion. Thus, while power may be supplied on a continuous basis from energy-storing capacitor ESC, power will only be drawn intermittently from the power line; which situation is illustrated by waveform (c) of FIG. 2.

However, when the power drained from energy-storing capacitor ESC equals the average power supplied from the power line, up-conversion takes place in an uninterrupted manner; which situation is illustrated by waveform (b) of FIG. 2. In fact, the average power drawn from the power line by the up-converter is intentionally arranged to be equal to the power drawn by the inverter from its DC supply voltage as long as the inverter is fully loaded; which is to say, as long as the fluorescent lamps are powered at their normally intended power level.

Since the amount of power drawn by the fully loaded inverter will increase with the magnitude of the DC supply voltage, no high accuracy is required with respect to the amount of power supplied by the up-converter. It only has to be equal to the power drawn by the fully loaded inverter at a DC supply voltage somewhere between 450 and 500 Volt. Moreover, as the power drawn by the inverter increases, the inverter's output current also increases; the effect of which is to cause the inversion frequency to increase, although to a less-than-proportional degree. Yet, due to the frequency-discriminating characteristics of the L-C series-resonant inverter output circuit, this increased frequency causes the amount of power drawn by the up-converter to decrease noticably; thereby providing for a substantial negative feedback effect, thereby further assisting in making it easy to reach the equilibrium required for stable non-intermittent full load operation.

Waveform (b) of FIG. 2 is substantially sinusoidal (i.e., with less than 10% total harmonic distortion). And, so is each individual half-wave of each intermittent burst of current illustrated by waveform (c). Actually, the pseudo-instantaneous magnitude (i.e., the magnitude as integrated over a full cycle of the 30 kHz inverter frequency) of the current drawn from the power line varies sinusoidally only when the magnitude of the DC supply voltage is much higher than the peak magnitude of the power line voltage. In instant case, the DC supply voltage has a magnitude about 2.5 times higher than the peak magnitude of the power line voltage; which is sufficiently high to cause the current drawn in response to the 120 Volt/60 Hz (sinusoidal) power line voltage to be sinusoidal with less than 10% total harmonic distortion.

With fluorescent lamps SCFL connected but before they have ignited, the magnitude of the ballast output voltage provided across ballast output terminals BOT1 and BOT2 is nearly 400 Volt RMS; which, with starting aid capacitor SAC and starting aid electrode SAE, is sufficient to properly rapid-start two series-connected 48"/T-12 fluorescent lamps.

As illustrated by waveform (j) of FIG. 2, the pre-ignition ballast output voltage consists of the vector sum of: (i) the 30 kHz nearly squarewave voltage present across tank capacitor C, which results from the voltage-clamping effect of rectifiers HR1 and HR2, and which is illustrated by waveform (i); and (ii) the 30 kHz voltage of more complex waveform provided at the output of auxiliary winding AW. This more complex waveform consists of portion of the voltage present across tank capacitor C (except being of opposite phase) to which is added a portion of the inverter's squarewave output voltage (which is about 90 degrees out of phase with the voltage across the tank capacitor).

Prior to lamp ignition, the RMS magnitude and the degree of squareness of the waveform of the 30 kHz voltage present across tank capacitor C depends upon the magnitude of the capacitance of auxiliary capacitor Ca. With Ca being of relatively small capacitance, this waveform is nearly sinusoidal and has an RMS magnitude substantially larger than that of the inverter's squarewave output voltage (whose RMS magnitude by necessity must be equal to half that of the DC supply voltage—i.e. between about 225 and 250 Volt). With Ca being of very large capacitance (or replaced with a short circuit), this waveform is almost like a squarewave and has an RMS magnitude about equal to or slightly less than that of the inverter's squarewave output voltage.

In the preferred embodiment, the value of auxiliary capacitor Ca is chosen such as to make the RMS magnitude of the 30 kHz voltage present across tank capacitor C equal to a little more than 250 Volt; and the number of turns of auxiliary winding AW is chosen such as to make the RMS magnitude of the 30 kHz voltage provided across this auxiliary winding to be about 200 Volt; which makes the vector sum of the two 30 kHz voltages (i.e., of the net ballast output voltage) have an RMS magnitude equal to about 400 Volt.

After lamp ignition, the magnitude of the 30 kHz ballast output voltage decreases to about 200 Volt RMS; and the magnitude of the 30 kHz voltage across tank capacitor C decreases correspondingly and sufficiently to stop any current from flowing through clamping rectifiers HR1 and HR2.

With the particular ballast output voltage indicated, the resulting (post-ignition) lamp current will be as illustrated by waveform (h) of FIG. 2; which waveform exhibits a crest factor of about 1.7; which is just low enough to be acceptable. However, if a larger fraction of the ballast output voltage were to be derived from auxiliary winding AW, the crest factor would become unacceptably high.

Additional Comments (a) The auxiliary DC supply voltage required for proper operation of bistable circuit element BCE is obtained by way of capacitor C2 from the inverter's squarewave output voltage. The magnitude of this auxiliary DC supply voltage (about 10 Volt) is determined by the zenering voltage of Zener diode Z2; and filtering of this DC voltage is accomplished via capacitor C3.

(b) The purpose of capacitors CC1 and CC2 is that of preventing low-frequency current from flowing from either of the ballast output terminals, whether through the fluorescent lamps or from one of the terminals to earth ground.

(d) To meet usual requirements with respect to EMI suppression, suitable filter means is included with bridge rectifier BR.

(e) Further details with respect to the operation of a half-bridge inverter is provided in U.S. Pat. No. 4,184,128 to Nilssen, particularly via FIG. 8 thereof.

(f) Power source S in FIG. 1 is shown as having one of its terminals connected with earth ground. In fact, it is standard practice that one of the power line conductors of an ordinary electric utility power line be electrically connected with earth ground.

(g) The B− bus of the ballast circuit of FIG. 2 is connected with one of the DC output terminals of bridge rectifier BR; which means that, at least intermittently, the B− bus is electrically connected with earth ground.

(h) The term "crest factor" pertains to a waveform and identifies the ratio between the peak magnitude of that waveform to the RMS magnitude of that waveform. Thus, in case of a sinusoidal waveform, the crest factor is about 1.4 in that the peak magnitude is 1.4 times as large as the RMS magnitude.

(i) The crest factor of waveform (b) of FIG. 2 is roughly equal to that of waveform (a); which is to say about 1.4.

(j) The power factor associated with the current depicted by waveform (b) of FIG. 2 is very high: just under 100%.

(k) The harmonic distortion of the FIG. 2 (b) waveform versus that of the FIG. 2 (a) waveform is very low: not higher than about 15%.

(l) Whenever it is not zero, waveform (c) of FIG. 2 is identical to waveform (b).

(m) Waveform (d) of FIG. 2, which is substantially a squarewave, has a crest factor of about 1.0.

(n) Waveform (e) of FIG. 2 has a crest factor under 1.4; waveform (f) has a crest factor of about 2.0; waveforms (g) and (h) each has a crest factor of about 1.7; waveform (i) has a crest factor under 1.4; and waveform (j) has a crest factor of just under 2.0.

(o) Waveform (j), which represents the open circuit (i.e., no load) 30 kHz ballast output voltage, has an instantaneous magnitude that is equal to the sum of the no-load voltage present across tank capacitor C and the no-load voltage present across auxiliary winding AW; which latter voltage is inverted and reduced in magnitude compared with the voltage present across the tank capacitor.

(p) The waveshape of the voltage across tank inductor L is equal to the vector sum of the inverter's 30 kHz squarewave output voltage—i.e., waveform (d)—and the 30 kHz voltage across the tank capacitor.

(q) In FIG. 1, auxiliary winding AW is indicated to be coupled with inductor L with a coupling factor less than 100%. To provide for improved waveforms and otherwise improved function, it is advantageous that the coupling factor be substantially lower than 100%.

(r) Instead of having auxiliary winding AW coupled with inductor L with less than 100% coupling factor (i.e., with less than 100% mutual inductance), a separate inductor may be used in series-connection with the output of auxiliary winding AW.

(s) It is emphasized that auxiliary capacitor Ca may in many situations advantageously be substituted with a short circuit.

What is claimed is:

1. An arrangement comprising:

a source operative to provide a power line voltage at a pair of power line terminals;

gas discharge lamp means having a pair of lamp terminals; and conditioning means having a pair of input terminals connected with the power line terminals and a pair of output terminals disconnectably connected with the lamp terminals; the conditioning means being operative to provide an AC output voltage at the output terminals; the AC output voltage being characterized by: (i) being of fundamental frequency different from that of the power line voltage; and (ii) whenever the lamp terminals are not connected with the output terminals, having an instantaneous magnitude that is the difference between a first AC voltage having a first fundamental frequency and a first waveshape and a second AC voltage having a second fundamental frequency and a second waveshape; the first fundamental frequency being equal to the second fundamental frequency; the first waveshape being substantially different from the second waveshape: the first AC voltage existing between one of the output terminals and a reference terminal; the second AC voltage existing between the other one of the output terminals and the reference terminal.

2. The arrangement of claim 1 wherein: (i) one of the power line terminals is electrically connected with earth ground; and (ii) a first alternating voltage exists between earth ground and one of the output terminals; (iii) a second alternating voltage exists between earth ground and the other one of the output terminals; and (iv) the waveshape of the first alternating voltage is substantially different from that of the second alternating voltage.

3. The arrangement of claim 1 wherein: (i) one of the power line terminals is electrically connected with earth ground; and (ii) a first alternating voltage exists between earth ground and one of the output terminals; (iii) a second alternating voltage exists between earth ground and the other one of the output terminals; and (iv) the crest factor of the first alternating voltage is substantially lower than that of the second alternating voltage.

4. The arrangement of claim 3 wherein the first alternating voltage is equal to the first AC voltage.

5. An arrangement comprising:

gas discharge lamp means having a pair of lamp terminals; and power supply means being connected with the power line voltage of an ordinary electric utility power line and having a pair of output terminals connected with the lamp terminals; the power supply means being operative to provide an AC voltage at the output terminals; the AC voltage being of fundamental frequency different from that of the power line voltage and characterized by having, prior to lamp ignition, an instantaneous magnitude that is the difference between: (i) a first AC voltage having a first fundamental frequency and a first waveshape, and (ii) a second AC voltage having a second fundamental frequency and a second waveshape; the first fundamental frequency being equal to the second fundamental frequency; the first waveshape being substantially different from the second waveshape; the first AC voltage being present between one of the output terminals and a reference terminal; the second AC voltage being present between the other one of the output terminals and the reference terminal.

6. The arrangement of claim 5 wherein the second AC voltage has a crest factor substantially higher than that of the first AC voltage.

7. An arrangement comprising:

source means operative to provide a power line voltage at a pair of power line terminals;

gas discharge lamp means having a pair of lamp terminals; and frequency-converting voltage conditioning means having a pair of input terminals connected with the power line terminals and a pair of output terminals connected with the lamp terminals; the voltage conditioning means being operative to provide an AC output voltage at the output terminals; the AC output voltage being of frequency different from that of the power line voltage and characterized by having, whenever the lamp means fails to draw a substantive amount of current from the output terminals, an instantaneous magnitude that is the difference between: (i) a first AC voltage having a first fundamental frequency and a first waveshape, and (ii) and a second AC voltage having a second fundamental frequency and a second waveshape; the first fundamental frequency being equal to the second fundamental frequency; the first waveshape being substantially different from the second waveshape; the first AC voltage existing between one of the output terminals and a reference terminal; the second AC voltage existing between the other one of the output terminals and the reference terminal.

8. The arrangement of claim 7 wherein the second waveshape has a substantially higher crest factor than that of the first waveshape.

9. The arrangement of claim 7 wherein: (i) the crest factor of the first waveshape is substantially lower than 1.7; and (ii) the crest factor of the second waveshape is substantially higher than 1.7.

10. The arrangement of claim 9 wherein, whenever the lamp means does indeed draw a substantive amount of current from the output terminals, the waveshape of this current has a crest factor not higher than about 1.7.

11. An arrangement comprising:

source means providing a squarewave voltage at a pair of squarewave terminals;

a gas discharge lamp means having a pair of lamp terminals; and tuned circuit means connected in circuit with the squarewave terminals; the tuned circuit means having a pair of output terminals connected with the lamp terminals; an AC output voltage being provided between these output terminals; the tuned circuit means also having a capacitor means and an inductor means; the capacitor means having a pair of capacitor terminals; the inductor means having an auxiliary winding with a pair of inductor terminals; a first AC voltage being provided between the capacitor terminals; a second AC voltage being provided between the inductor terminals; the instantaneous magnitude of the AC output voltage being the difference between: (i) the instantaneous magnitude of the first AC voltage, and (ii) the instantaneous magnitude of the second AC voltage; the first AC voltage existing between one of the output terminals and a reference terminal; the second AC voltage existing between the other one of the output terminals and the reference terminal.

12. The arrangement of claim 11 wherein: (i) the first AC voltage has a first waveshape; (ii) the second AC voltage has a second waveshape; and (iii) the first waveshape is substantially different from the second waveshape.

13. The arrangement of claim 11 wherein: (i) the first AC voltage has a first crest factor; (ii) the second AC voltage has a second crest factor; and (iii) the second crest factor is substantially higher than the first crest factor.

14. The arrangement of claim 11 wherein: (i) the capacitor means and the inductor means are series-connected across the sqaurewave terminals; and (ii) series-resonant at or near the fundamental frequency of the squarewave voltage.

15. An arrangement comprising:

a source operative to provide a power line voltage at a pair of power line terminals;

gas discharge lamp means having a pair of lamp terminals; and conditioning means having a pair of input terminals connected with the power line terminals and a pair of output terminals disconnectably connected with the lamp terminals; the conditioning means being operative to draw a power line current from the power line terminals and to provide an AC output voltage between the output terminals; the AC output voltage being characterized by: (i) being of fundamental frequency different from that of the power line voltage; and (ii) whenever the lamp terminals are not connected with the output terminals, having an instantaneous magnitude that is the difference between a first AC voltage having a first fundamental frequency and a first waveshape and a second AC voltage having a second fundamental frequency and a second waveshape; the first fundamental frequency being equal to the second fundamental frequency; the first waveshape being substantially different from the second waveshape; the first AC voltage existing between one of the output terminals and a given reference terminal; the second AC voltage existing between the other one of the output terminals and the same given reference terminal.

16. The arrangement of claim 15 wherein: (i) the waveform of the power line voltage consists of a continuous sequence of sinusoidally-shaped half-cycles; and (ii) in certain situations, the conditioning means draws power line current only during some, but not during all, of said half-cycles.

* * * * *